US006436339B1

(12) United States Patent
Maziasz et al.

(10) Patent No.: US 6,436,339 B1
(45) Date of Patent: Aug. 20, 2002

(54) CAST B2-PHASE IRON-ALUMINUM ALLOYS WITH IMPROVED FLUIDITY

(76) Inventors: Philip J. Maziasz, 122 Clark La., Oak Ridge, TN (US) 37830; Alan M. Paris, P.O. Box 64, Tarrs, PA (US) 15688; Joseph D. Vought, 124 Cove Point Rd., Rockwood, TN (US) 37854

( * ) Notice: Subject to any disclaimer, the term of this patent is extended or adjusted under 35 U.S.C. 154(b) by 0 days.

(21) Appl. No.: 09/461,566

(22) Filed: Dec. 14, 1999

(51) Int. Cl.[7] ..... C22C 38/06
(52) U.S. Cl. ..... 420/77; 420/78; 148/320
(58) Field of Search ..... 420/77, 78; 148/320

(56) References Cited

U.S. PATENT DOCUMENTS

| | | | | |
|---|---|---|---|---|
| 3,871,868 A | * | 3/1975 | Renaud | 420/77 |
| 5,160,557 A | * | 11/1992 | Chang | 148/546 |

FOREIGN PATENT DOCUMENTS

| | | | | |
|---|---|---|---|---|
| GB | 1134638 | * | 11/1968 | 420/77 |
| GB | 1316186 | * | 5/1973 | 420/78 |
| JP | 56-18070 | * | 4/1981 | 420/77 |

OTHER PUBLICATIONS

McKamey et al., "A review of recent developments in $Fe_3A1$–based alloys," *J. Mater. Res.*, vol. 6, No. 8, Aug. 1991, 1779–1805.

Stoloff, N.S. and Liu, C.T., "Environmental embrittlement of iron aluminides," *Intermetallics* 2 (1994) 75–87.

Liu et al., "Recent advances in B2 iron aluminide alloys: deformation, fracture and alloy design," *Materials Science and Engineering* A258 (1998) 84–98.

Stoloff, N.S. and Liu, C.T., "Iron Aluminides," *Microstructure and Properties of Materials*, vol. 2, 138–43; 172–77, 10–99.

McKamey, C.G. et al., "A Review of Recent Developments in $Fe_3A1$–Based Alloys", *Journal of Materials Research*, vol. 6, No. 8, Aug. 1991, pp. 1779–1805.

Viswanathan, S. et al., "Microstructures And Tensile Properties of As–Cast Iron–Aluminide Alloys", Processing, Properties, and Applications of Iron Aluminides, Annual Meeting of The Minerals, Metals & Materials Society in San Francisco, California, Feb. 27–Mar. 3, 1994, pp. 159–169.

Maziasz, P.J. et al., "Alloy Development and Processing Effects for FeA1 Iron Alumnides: An Overview", *International Symposium on Nickel and Iron Aluminides: Processing, Properties, and Applications*, Proceedings from Materials Week '96, Oct. 7–9, 1996, pp. 157–176.

* cited by examiner

*Primary Examiner*—Deborah Yee
(74) *Attorney, Agent, or Firm*—Gray Cary Ware & Freidenrich LLP

(57) ABSTRACT

Systems and methods are described for iron aluminum alloys. A composition includes iron, aluminum and manganese. A method includes providing an alloy including iron, aluminum and manganese; and processing the alloy. The systems and methods provide advantages because additions of manganese to iron aluminum alloys dramatically increase the fluidity of the alloys prior to solidification during casting.

34 Claims, 1 Drawing Sheet

CAST B2-PHASE IRON-ALUMINUM ALLOYS WITH IMPROVED FLUIDITY

STATEMENTS AS TO RIGHTS TO INVENTIONS MADE UNDER FEDERALLY-SPONSORED RESEARCH AND DEVELOPMENT

This invention was made with Government support under contact no. DE-AC05–96OR22464 awarded by the United States Department of Energy. The Government has certain rights in the invention.

BACKGROUND OF THE INVENTION

1. Field of the Invention

The invention relates generally to the field of iron aluminum alloy compositions. More particularly, the invention relates to additives for the improvement of iron aluminum alloy fluidity, especially during casting processes.

2. Discussion of the Related Art

Most development of FeAl alloys with more than 30 at. % aluminum has focused on wrought or powder-metallurgy processing avenues to final product form and metallurgical properties. There has been relatively little work on cast iron-aluminide alloys of any composition, because these coarser-grained products tend to have low ductility at room-temperature relative to wrought material.[1–3]

Recently it was discovered that certain FeAl alloys with 30–40 at. % aluminum, and minor solute additions of Mo, Zr, C, and B can have good room-temperature ductility and impact-toughness as well as good high-temperature strength, even in the cast condition. Further, outstanding corrosion resistance has been found in cast FeAl alloys with regard to oxidation, carburization and sulfidation resistance at temperatures of 800–1200° C.

A problem with these FeAl alloys has been lack of fluidity during casting. Fluidity is an essential parameter for mold filling, surface finish, detail definition and other properties necessary to make various kinds of cast metal parts. The fluidity of FeAl alloys is important to sand casting, centrifugal casting, and pressure or vacuum casting processes to make various components and parts. Typically, various heat-resistant and corrosion resistant are cast from HU, HK or HP austenitic stainless steels or alloys or CB ferritic stainless steels. Benchmarking new FeAl alloy behavior relative to conventional Fe—Cr—Ni alloys is, therefore, important prior to introducing FeAl alloys into commercial casting technology.

Heretofore, the need for fluidity in iron aluminum alloys has not been fully met. What is needed is a solution that addresses this fluidity requirement. The invention is directed to meeting this requirement, among others.

SUMMARY OF THE INVENTION

A goal of the invention is to satisfy the above-discussed requirement of fluidity in iron aluminum alloys which, in the case of the prior art, is not satisfied.

One embodiment of the invention is based on a composition, comprising: iron, aluminum and manganese. Another embodiment of the invention is based on an apparatus, comprising: a component including iron, aluminum and manganese. Another embodiment of the invention is based on a method, comprising: providing an alloy including iron, aluminum and manganese; and processing said alloy.

These, and other goals and embodiments of the invention will be better appreciated and understood when considered in conjunction with the following description and the accompanying drawings. It should be understood, however, that the following description, while indicating preferred embodiments of the invention and numerous specific details thereof, is given by way of illustration and not of limitation. Many changes and modifications may be made within the scope of the invention without departing from the spirit thereof, and the invention includes all such modifications.

BRIEF DESCRIPTION OF THE DRAWINGS

A clear conception of the advantages and features constituting the invention, and of the components and operation of model systems provided with the invention, will become more readily apparent by referring to the exemplary, and therefore nonlimiting, embodiments illustrated in the drawings accompanying and forming a part of this specification. It should be noted that the features illustrated in the drawings are not necessarily drawn to scale.

DESCRIPTION OF PREFERRED EMBODIMENTS

Figure 1:
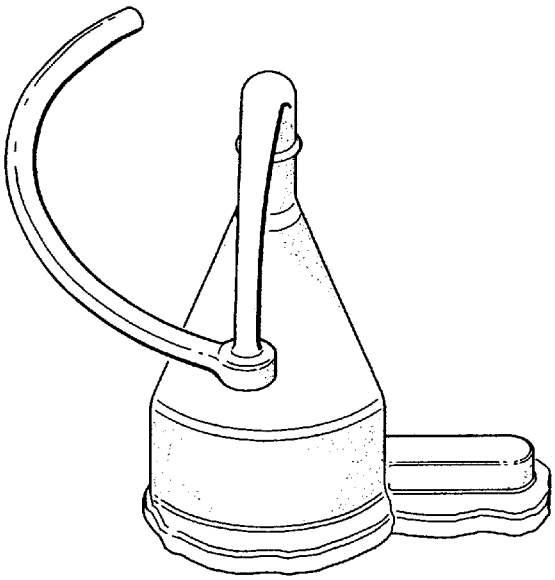
FIG. 1 (PRIOR ART)
FIG. 1 illustrates a spiral fluidity test casting of a base FA386M1 iron-aluminide alloy, appropriately labeled "prior art."

The invention and the various features and advantageous details thereof are explained more fully with reference to the nonlimiting embodiments that are illustrated in the accompanying drawings and detailed in the following description of preferred embodiments. Descriptions of well known components and processing techniques are omitted so as not to unnecessarily obscure the invention in detail.

Within this application several publications are referenced by superscripts composed of Arabic numerals within parentheses. Full citations for these publications may be found at the end of the specification immediately preceding the claims after the section heading References. The disclosures of all these publications in their entireties are hereby expressly incorporated by reference into the present application for the purpose of indicating the background of the invention and illustrating the state of the art.

The below-referenced U.S. Patents disclose embodiments that were satisfactory for the purposes for which they were intended. The entire contents of U.S. Pat. Nos. 5,545,373; 5,320,802; and 4,961,903 are hereby expressly incorporated by reference into the present application as if fully set forth herein.

The context of the invention includes iron aluminum alloys. The invention includes iron aluminum alloy compositions having from approximately 20 weight percent to approximately 60 weight percent aluminum, preferably from approximately 30 to approximately 45 weight percent aluminum, more preferably greater than approximately 30 weight percent aluminum. The context of the invention also includes casting techniques, for example, continuous casting.

The invention includes alloys composed of iron, aluminum and manganese. Unexpectedly, it has been discovered that additions of manganese dramatically increase the fluidity of superheated, molten B2-phase FeAl alloys prior to solidification during casting. The increase in fluidity can be achieved with minor additions of manganese. The invention includes FeAl manganese additions of from approximately 0.01 weight percent to approximately 10.0 weight percent, preferably from approximately 0.1 weight percent to approximately 1.0 weight percent, more preferably 0.5 weight percent.

The invention also includes alloys composed of iron, aluminum and silicon. Also unexpectedly, it has also been discovered that additions of silicon, which normally increase fluidity in comparable heat-resistant cast austenitic stainless steels and alloys, reduce the fluidity of FeAl alloys. The invention includes FeAl silicon additions of from approximately 0.01 weight percent to approximately 10.0 weight percent, for example from approximately 0.1 weight percent to approximately 1.0 weight percent.

The invention also includes components that include iron aluminum alloys with additions of manganese and/or silicon, as well as more complex equipment that includes such components. The invention also includes methods of processing iron aluminum alloys having additions of manganese and/or silicon.

The invention can also utilize data processing methods that transform signals to alter the composition, a casting process and/or the casting equipment. For example, the invention can be combined with instrumentation to obtain state variable information from the composition, the castings and/or the casting equipment to actuate interconnected discrete hardware elements. For instance, the invention can include actuating batching apparatus to add more, or less, manganese to an FeAl alloy to increase, or decrease, fluidity during a continuous casting process.

The term approximately, as used herein, is defined as at least close to a given value (e.g., preferably within 10% of, more preferably within 1% of, and most preferably within 0.1% of). The term substantially, as used herein, is defined as at least approaching a given state (e.g., preferably within 10% of, more preferably within 1% of, and most preferably within 0.1% of). The term minor, as used herein, is defined as small (e.g., preferably less than 10 weight %, more preferably less than 1 weight % of, and most preferably less than 0.1 weight %).

EXAMPLES

Specific embodiments of the invention will now be further described by the following, nonlimiting examples which will serve to illustrate in some detail various features of significance. The examples are intended merely to facilitate an understanding of ways in which the invention may be practiced and to further enable those of skill in the art to practice the invention. Accordingly, the examples should not be construed as limiting the scope of the invention.

The composition of HK-40, a standard commercial cast austenitic alloy used for applications that require high-temperature corrosion resistance, and four FeAl alloys are listed in Table 1. The first row labeled HK-40 shows the standard commercial cast austenitic alloy.

The second row labeled FA386M1 shows the base (i.e., control) iron aluminum composition. FA386M1 was chosen as the FeAl base alloy composition because it has the best current combination of room-temperature ductility and Charpy impact toughness, and it has been tried in several scale-up commercial casting applications.

TABLE 1

Compositions of HK-40 and FeAl Alloys Tested for Fluidity (wt. %)

| Alloy | Al | Cr | Ni | Mo | Zr | C | B | Si | Mn | Fe |
|---|---|---|---|---|---|---|---|---|---|---|
| HK-40 | — | 24.5 | 19.2 | — | — | 0.4 | — | 1.5 | 0.8 | bal. |
| FA386M1 | 22.1 | — | — | 0.42 | 0.1 | 0.2 | 0.005 | — | — | bal. |
| FeAl + Si1 | 22.1 | — | — | 0.42 | 0.1 | 0.2 | 0.005 | 0.1 | — | bal. |
| FeAl + Si2 | 22.1 | — | — | 0.42 | 0.1 | 0.2 | 0.005 | 0.5 | — | bal. |
| FeAl + Mn | 22.1 | — | — | 0.42 | 0.1 | 0.2 | 0.005 | — | 0.5 | bal. |

The third row labeled FeAl+Si1 shows the inventive example containing 0.1 wt. % silicon. The fourth row labeled FeAl+Si2 shows the inventive example containing 0.5 wt. % silicon. The fifth row labeled FeAl+Mn shows the inventive example containing 0.5 wt. % manganese.

The fluidity test included using a standard spiral shaped mold to make the appropriate pattern in green sand, and then induction melting a similar amount of metal in air with an argon cover gas, superheating to a pouring temperature of 1600° C., and then pouring the molten metal into the sand mold. Relative fluidity is measured by how far each molten metal flows around the spiral path before it freezes.

Figure 2:
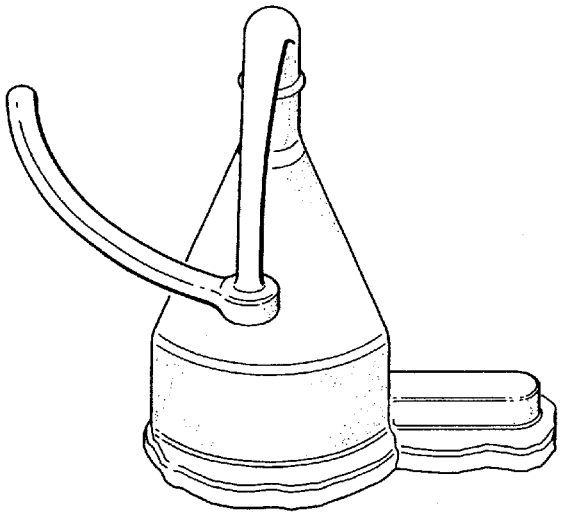
FIG. 2, the base FA386M1 FeAl alloy with 0.5 wt. % Si added; representing an embodiment of the invention.
Figure 3:
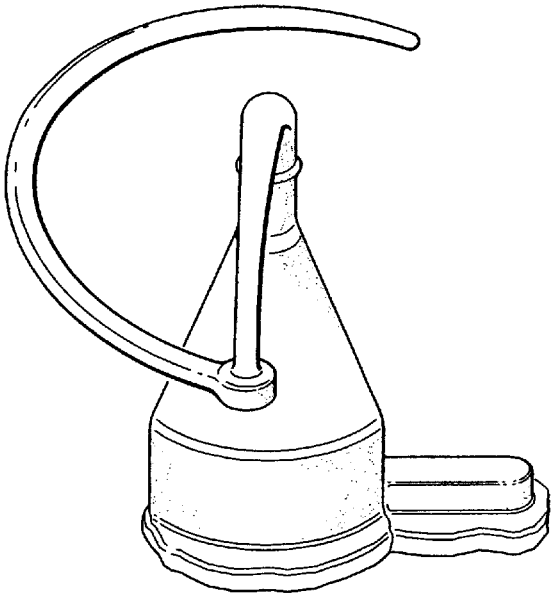
FIG. 3, the base FA386M1 FeAl Alloy with 0.5 wt. % Mn added, representing an embodiment of the invention.

Results of all the fluidity tests for the five sample compositions are given in Table 2. Images of the cast samples corresponding to rows 2, 4 and 5 are shown in FIGS. 1, 2 and 3.

TABLE 2

Flow Arc Length for Various Alloys for Standard Fluidity Test

| Alloy | Flow Arc Length (inches) |
|---|---|
| HK-40 | 9.75 |
| FA386M1 (FeAl) | 11.25 |
| FeAl + Si1 | 9.6 |
| FeAl + Si2 | 5.15 |
| FeAl + Mn | 14.2 |

It can be seen from Table 2 that the unmodified FeAl alloy (row 2) showed slightly better fluidity than HK-40 (row 1), which is commonly centrifugally cast into various tubing or roll products, including radiant-heating tube and ethylene cracker applications. Silicon is the most important additive to enhance the fluidity of Fe—Cr—Ni alloys, and generally is beneficial to improving high temperature corrosion resistance as well. Silicon is not necessary for improving the high-temperature oxidation and corrosion resistance of FeAl alloys, because their super-corrosion resistance is based on the formation and adherence of alumina scales. Silicon additions of 0.1 and 0.5 wt. % additions were made. Referring to the third row of table 2 labeled FeAl+Si1, an addition of 0.1 wt. % silicon slightly reduced the fluidity. Referring to the fourth row of table 2 labeled FeAl+Si2, the addition of 0.5 wt. % silicon reduced the fluidity by more than 50%. In contrast, referring to the fifth row of table 2 labeled FeAl+Mn, the addition of 0.5 wt. % manganese significantly improved the fluidity significantly.

Generally Fe—Cr—Ni alloys with silicon levels below 0.2–0.4 are not used due to a lack of metal fluidity. The result of reduced fluidity with the addition of silicon to the FeAl base alloy was unexpected. Clearly Si addition reduces fluidity whereas the Mn addition improves it. The increased fluidity of FeAl with manganese added instead of silicon was a significant discovery. Several wrought FeAl alloys have been characterized with up to 1 wt. % added manganese.

The invention has been laboratory tested for cast FeAl alloys in the 36–40 at. % aluminum range. The invention is applicable to alloys with less aluminum that have different phase structures or microstructures. The invention enable continuous casting and direct hot-working relative to more conventional ingot-casting, depending on the effects of the manganese additions on high-temperature ductility and strength.

Referring to Table 3, two heats of cast FeAl+0.1 wt. % Mn (heats 17076 and 17144, identical compositions) were made and tested for tensile properties and Charpy impact toughness at room temperature 23° C. Basically they both showed the same ductility, strength, and impact toughness as Mn-free FeAl, demonstrating the significant fact that increased fluidity does not come at the expense of other important properties.

TABLE 3

| | | Physical Properties | | | |
|---|---|---|---|---|---|
| Alloy | Heat-Treatment | YS | UTS | Total elongation | Chary impact |
| 17076 | 1 h at 750° C. | 59.1 ksi | 62.5 ksi | 1.2% | 6 ft-lbs |
| | 1 h at 1200° C. | 72.1 | 72.1 | <0.5 | 6–7 |
| 17144 | 1 h at 750° C. | 61.6 ksi | 64.3 ksi | 1.4% | 5.5 |
| | 1 h at 1200° C. | 59.6 | 59.6 | <0.5 | 6.0 |
| FeAl | 1 h at 750° C. | 61.2 ksi | 62.8 ksi | 1.0% | 6.0 |
| (control no Mn) | 1 h at 1200° C. | 71.8 | 72.8 | 1.5 | 7.5 |

Practical Applications of the Invention

A practical application of the invention that has value within the technological arts is the use of super-corrosion-resistant FeAl alloys to replace comparable cast austenitic and ferritic stainless steels and alloys in metals processing, heat-treating or petrochemical and chemical processing applications (tubes, rolls, pipes, furnace hardware and furniture). Cast iron-alumindes, either monolithic or cast as bi-metal tubing in combination with other stainless steels or alloys, are of particular use to the chemical (e.g., petrochemical) industry because $FeAl_3$ is uniquely resistant to coking and carburization. Further, the invention is useful in conjunction with automotive applications, like cast exhaust manifolds, or the like. Cast or wrought FeAl alloys also show anomalous resistance to molten salts, including the extremely aggressive molten carbonate salts used in fuel cell technology. There are virtually innumerable uses for the invention, all of which need not be detailed here.

Advantages of the Invention

A composition, apparatus and/or method representing an embodiment of the invention, can be cost effective and advantageous for at least the following reasons. The invention permits better liquid metal flow, mold-filling, ability to cast more complex shapes and parts, and smoothness of cast surface, for any casting method. The invention permits better components (solid metal with fewer casting defects) in both static mold and centrifugally-cast products. The invention enables casting of thinner-walled components (i.e., automotive exhaust manifolds produced by the modified Hitchner process) that are not possible without sufficient liquid metal flow properties. The invention is beneficial in any FeAl powder-making process, where liquid metal is atomized or otherwise processed to particular shaped or uniformly-sized droplets. The invention permits better as-cast surfaces that can eliminate machining or grinding operations and be ready for service in various steel or metals processing rolls applications. The invention may also be implemented as a plasma- or thermal-spray FeAl coat to protect other materials, for example, to protect metals from corrosion or oxidation.

All the disclosed embodiments of the invention described herein can be realized and practiced without undue experimentation. Although the best mode of carrying out the invention contemplated by the inventors is disclosed above, practice of the invention is not limited thereto. Accordingly, it will be appreciated by those skilled in the art that the invention may be practiced otherwise than as specifically described herein.

For example, the individual components need not be formed in the disclosed shapes, or assembled in the disclosed configuration, but could be provided in virtually any shape, and assembled in virtually any configuration. Further, the individual components need not be fabricated from the disclosed materials, but could be fabricated from virtually any suitable materials. Further, although the composition(s) and/or component(s) described herein can be physically separate modules, it will be manifest that the composition(s) and/or component(s) may be integrated into the apparatus with which it(they) is(are) associated. Furthermore, all the disclosed elements and features of each disclosed embodiment can be combined with, or substituted for, the disclosed elements and features of every other disclosed embodiment except where such elements or features are mutually exclusive.

It will be manifest that various additions, modifications and rearrangements of the features of the invention may be made without deviating from the spirit and scope of the underlying inventive concept. It is intended that the scope of the invention as defined by the appended claims and their equivalents cover all such additions, modifications, and rearrangements.

The appended claims are not to be interpreted as including means-plus-function limitations, unless such a limitation is explicitly recited in a given claim using the phrase "means for." Expedient embodiments of the invention are differentiated by the appended subclaims.

REFERENCES

1. P.J. Maziasz, G. M. Goodwin, D.J. Alexander, S. Viswanathan, "Alloy Development and Processing Effects for FeAl Aluminides: An Overview," *Proc. Internat. Symp. On Nickel and Iron Aluminides: Processing, Properties and Applications,* eds. S.C. Deevi, P.J. Maziasz, V. K. Sikka and R. W. Cahn, ASM-International, Materials Park, Ohio (1997) pages 157–176.
2. S. Viswanathan, C. G. McKamey, P. J. Maziasz and V. K. Sikka, "Microstructure and Tensile Properties of As-Cast Iron-Aluminide Alloys," *Processing Properties and Applications of Iron Aluminides,* eds., J. H. Schneibel and M. A. Crimp, The Minerals, Metals and Materials Society, Warrendale, Pa. (1994) pages 159–169.
3. C.G. McKamey, J.H. DeVan, P.F. Tortorelli and V.K. Sikka, "A Review of Recent Developments in $Fe_3Al$-based Alloys," *J. Materials Research,* 6 (1991) pages 1779–1805.

What is claimed is:

1. A composition, comprising a cast B2-phase FeAl alloy including:

iron;

from approximately 20 to approximately 25 weight percent aluminum; and from approximately 0.01 to approximately 5 weight percent manganese.

2. The composition of claim 1, wherein aluminum composes approximately 22.1 weight percent of said composition.

3. The composition of claim 1, wherein manganese composes from approximately 0.1 weight percent to approximately 1.0 weight percent of said composition.

4. The composition of claim 3, wherein manganese composes approximately 0.5 weight percent of said composition.

5. The composition of claim 1, further comprising from approximately 0.1 to approximately 2.0 weight percent silicon.

6. An apparatus, comprising a cast B2-phase FeAl alloy component including iron, from approximately 20 to approximately 25 weight percent aluminum and from approximately 0.01 to approximately 5 weight percent manganese.

7. The apparatus of claim 6, wherein aluminum composes approximately 22.1 weight percent of said component.

8. The apparatus of claim 6, wherein manganese composes from approximately 0.1 weight percent to approximately 1.0 weight percent of said component.

9. The apparatus of claim 8, wherein manganese composes approximately 0.5 weight percent of said component.

10. The apparatus of claim 6, wherein said component includes from approximately 0.1 to approximately 2.0 weight percent silicon.

11. A method, comprising:

providing a cast B2-phase FeAl alloy including iron, from approximately 20 to approximately 25 weight percent aluminum and from approximately 0.01 to approximately 5 weight percent manganese; and processing said cast B2-phase FeAl alloy.

12. The method of claim 11, wherein processing said alloy includes at least partially filling a mold space with said alloy under casting conditions.

13. The method of claim 11, wherein providing an alloy includes providing an alloy containing approximately 22.1 weight percent aluminum.

14. The method of claim 11, wherein providing an alloy includes providing an alloy containing from approximately 0.1 weight percent to approximately 1.0 weight percent manganese.

15. The method of claim 14, wherein providing an alloy includes providing an alloy containing approximately 0.5 weight percent manganese.

16. The method of claim 14, wherein providing an alloy includes providing an alloy containing from approximately 0.1 to approximately 2.0 weight percent silicon.

17. A composition, comprising a cast B2-phase FeAl alloy including:

iron;

from approximately 20 to approximately 25 weight percent aluminum; and from approximately 0.01 to approximately 5 weight percent silicon.

18. An apparatus, comprising a cast B2-phase FeAl alloy component including iron, approximately 25 weight percent aluminum and from approximately 0.01 to approximately 5 weight percent silicon.

19. A method, comprising:

providing a cast B2-phase FeAl alloy including iron, from approximately 20 to approximately 25 weight percent aluminum and from approximately 0.01 to approximately 5 weight percent silicon; and processing said cast B2-phase FeAl alloy.

20. The composition of claim 1, further comprising 0.42 weight percent Mo.

21. The composition of claim 1, further comprising 0.1 weight percent Zr.

22. The composition of claim 1, further comprising 0.2 weight percent C.

23. The composition of claim 1, further comprising 0.005 weight percent B.

24. The apparatus of claim 6, wherein the cast B2-phase FeAl alloy component includes 0.42 weight percent Mo.

25. The apparatus of claim 6, wherein the cast B2-phase FeAl alloy component includes 0.1 weight percent Zr.

26. The apparatus of claim 6, wherein the cast B2-phase FeAl alloy component includes 0.2 weight percent C.

27. The apparatus of claim 6, wherein the cast B2-phase FeAl alloy component includes 0.005 weight percent B.

28. The method of claim 11, wherein providing includes providing a cast B2-phase FeAl alloy including 0.42 weight percent Mo.

29. The method of claim 11, wherein providing includes providing a cast B2-phase FeAl alloy including 0.1 weight percent Zr.

30. The method of claim 11, wherein providing includes providing a cast B2-phase FeAl alloy including 0.2 weight percent C.

31. The method of claim 11, wherein providing includes providing a cast B2-phase FeAl alloy including 0.005 weight percent B.

32. The composition of claim 17, further comprising from 0.1 to approximately 2.0 weight percent manganese.

33. The apparatus of claim 18, wherein the cast B2-phase FeAl alloy component includes from 0.1 to approximately 2.0 weight percent manganese.

34. The method of claim 19, wherein providing includes providing a cast B2-phase FeAl alloy including from 0.1 to approximately 2.0 weight percent manganese.

* * * * *